United States Patent [19]

Yamaki

[11] Patent Number: 4,712,266

[45] Date of Patent: Dec. 15, 1987

[54] WHISK PICK

[75] Inventor: Chikara Yamaki, Sendai, Japan

[73] Assignee: Fan Out Co., Ltd., Orange, Calif.

[21] Appl. No.: 946,653

[22] Filed: Dec. 23, 1986

Related U.S. Application Data

[63] Continuation of Ser. No. 764,420, Aug. 9, 1985, abandoned.

[51] Int. Cl.[4] ..... A46B 9/04

[52] U.S. Cl. ..... 15/167.1; 15/144 R; 15/172; 132/89; 433/141

[58] Field of Search ..... 15/105, 111, 143 R, 15/144 R, 167 R, 172; 128/62 A; 132/89, 93; 433/141

[56] References Cited

U.S. PATENT DOCUMENTS

| | | | |
|---|---|---|---|
| D. 270,669 | 9/1983 | Cassai et al. | D4/133 X |
| 1,517,613 | 12/1924 | Carr | 15/172 X |
| 1,575,317 | 3/1926 | Carmichael | 132/93 |
| 1,602,531 | 10/1926 | Itoh | 15/167 R |
| 1,899,090 | 2/1933 | Goard | 15/144 R |
| 3,609,789 | 10/1971 | Slater | 15/167 R |
| 4,535,761 | 8/1985 | Rabinowitz | 128/62 A |

*Primary Examiner*—Peter Feldman

*Attorney, Agent, or Firm*—Knobbe, Martens, Olson & Bear

[57] ABSTRACT

A disposable dental cleaning device that combines the portability and utility features of a toothpick with the cleaning ability of a brush is provided. A linear member of a semi-resilient material has a brush attached to one end and may be provided with a conventional point or rounded tip at the opposite end. A section of reduced thickness or a neck is formed in a portion of the linear member adjacent the attached brush enabling the brush to bend at an angle with respect to the linear member to enhance the cleaning ability of the appliance.

9 Claims, 3 Drawing Figures

WHISK PICK

This application is a continuation of application Ser. No. 764,420, filed Aug. 9, 1985, now abandoned.

FIELD OF THE INVENTION

The present invention relates to tooth and gum care devices, and more particularly to disposable dental care products designed for use while away from the home, especially in conjunction with and subsequent to meals eaten away from home.

DESCRIPTION OF THE PRIOR ART

That the majority of mankind has been plagued by tooth and gum disease finds support in the autopsy reports made on the ancient Egyptian mummys and in the stories that have now become legend about George Washington's false teeth. The explosion of advertising and other former "consumer" marketing techniques by the over-supply of dentists has announced the arrival and testifies to the effectiveness of preventive dentistry in reducing the problems and discomfort caused by a number of dental pathologies.

The recent strides in preventive dentistry owe much to the research work that has provided, for the first time, a scientific explanation for the processes of tooth decay and gum disease. Although bacteria had long been implicated in tooth decay, in combination with sugar and other simple carbohydrates, the specific process of tooth decay was not understood until fairly recently. Tooth enamel is not a particularly favorable environment for the decay-causing bacteria. However, other types of bacteria are able to flourish on tooth enamel, and as they grow, a thin layer or film is formed on the tooth surface. This film, known as plaque, creates a favorable matrix or medium in which the cavity-causing bacteria can grow. Among the by-products of this growth, the rate of which depends upon the amount and nature of the sugars and simple carbohydrates, are various organic acids that attack the enamel and ultimately produce cavities. The plaque layer also serves to keep these acidic by-products adjacent the tooth enamel, protecting them from the various mechanical abrasive elements normally existing in a person's mouth.

Not only is plaque a key component in the process of tooth decay, plaque also plays a central role in periodontal gum disease. Unless removed, the plaque layer becomes thicker and starts hardening into a material known as tartar or calculus. This transformation occurs first and most easily on those areas of the tooth that do not receive mechanical abrasion, such as around the base of the teeth, and at the tooth/gum interface. This build-up of calculus irritates the adjacent gum tissue, causing it to pull away from the tooth. The retreat of gum tissues opens additional areas of the tooth surface to attack, causing additional gum tissue regression. If unchecked, this process results in not only the loss of the involved tooth, but also in the destruction of the surrounding bone tissue of the jaw.

The key to preventive dental hygiene is plaque removal. If removed, there is no longer a matrix for the cavity-causing bacteria, nor for the acidic waste by-products. In addition, while plaque can easily be removed by simple abrasive action, calculus is a much harder substance and can only be effectively removed by a dental professional.

Although it would be more convenient to remove plaque by simply rinsing with a chemical solution, such as is suggested by the method of Rölla, et al., (U.S. Pat. No. 4,218,434), removal by mechanical action is far more certain and reliable. Toothbrushes are the device of choice for the majority of people, and their structure can range from the traditional stem-and-brush arrangement, to the curved and canted brush of Stanford, Jr., (U.S. Pat. No. 4,517,701), the addition of an inter-dental brush in Kim (U.S. Pat. No. 3,934,298), and, where manual action is not enough, the oscillating power brush of Sinclair (U.S. Pat. No. 4,134,169). Some toothbrushes have also been designed to enable the brush surface to change angles with respect to the stem, such as the rotational bristle head of Hadary, (U.S. Pat. No. 4,370,773).

Toothbrushes are superb at applying mechanical abrasion to the large, exposed tooth surfaces. The non-brush devices such as that shown in Kline (U.S. Pat. No. 4,367,759) have never proved commercially successful for home users. However, conventional brushes have difficulty in reaching the spaces between teeth. It is, unfortunately, this area between the teeth and around the tooth/gum interface that is among the most critical areas for tooth and gum disease. The mechanical action of chewing does not effectively clean out these areas and any cleaning will rely entirely upon the techniques of good oral hygiene. While chemical means have been suggested for these areas, such as the toothpaste applicator of Axelsson (U.S. Pat. No. 4,411,623), the brush has been the more popular from a design standpoint, as is shown by the structures of Tarrson, et al., (U.S. Pat. Nos. 4,222,143 and 4,319,377), and by Kigyos (U.S. Pat. No. 4,387,479).

The maximum level of plaque removal cannot be obtained by simple brushing alone. The suggested regimen of the American Dental Association consists of both brushing and flossing. A structure that combines both of these techniques is shown by Gambaro (U.S. Pat. No. 4,280,518).

When away from home, however, the principal difficulty with the foregoing devices is that, except for flossing, all require the use of water in conjunction with their application of mechanical action. When dining out it is difficult to obtain the required privacy and a source of water. Even though dental floss does not require water, public flossing has yet to be declare socially acceptable. Toothpicks are presently the only public dental cleaning device that has found social acceptability, (at least in certain geographic areas of the country and within certain socio-economic stratas). Traditionally manufactured from wood, and sometimes flavored, toothpicks have recently been manufactured out of synthetic materials such as the thin, flexible sheets disclosed in Lichfield (U.S. Pat. No. 4,304,245).

While toothpicks may have their place in removing relatively large pieces of food that have become wedged between teeth, they are totally inadequate with respect to plaque removal. They were never intended to be scraped along a tooth surface, and their stiffness and sharp tip tend to injure the soft gum tissue, causing more harm than good. There is thus presently no consumer-oriented dental device suitable for use after meals eaten away from home. Other than the ineffective technique of rinsing with various mouthwashes, the only present alternative to maintaining good oral hygiene after eating a meal when away from home is to actually bring a toothbrush and use it in a restroom, a practice that is not common for a number of understandable reasons.

SUMMARY OF THE INVENTION

The present invention has as an underlying objective an improvement in the heretofore-known types of dental cleaning appliances by the provision of a toothpick-sized device having a structure that will enhance the ability of the dental appliance to remove food and plaque in comparison to the presently available toothpicks and like appliances.

This goal is inventively achieved by providing a brush located at the end of a bendable tip of toothpick-sized piece of plastic. The provision of the brush enables sufficient abrasive forces to be applied to the tooth surface, in a safe manner, to remove or disturb the plaque layer. The ability of the brush to be bent enhances the cleaning ability over that of a straight, non-bendable appliance.

The "bendable" property is obtained by a necking formed in the pick towards the brush end thereof. The pick material is selected such that when bent at this neck area, the bent-pick portion will retain its angular displacement from linear until returned to its original shape by the user. This bending feature, combined with the provision of a brush, dramatically increases the versatility over a simple linear pick. Under the present invention, the bendable brush provision enables the user to easily clean the difficult-to-reach places between and in the back of the upper and lower dentitions, particularly in the bicuspid and molar regions. In addition, the materials used to manufacture the pick according to the present invention permit its reuse, and are also inexpensive enough to make this item entirely disposable in much the same manner as the traditional wooden toothpicks.

Various other objects, advantages, and features of the present invention will become readily apparent from the ensuing detailed description, and the novel features will be particularly pointed out in the appended claims.

DESCRIPTION OF THE PREFERRED EMBODIMENT

Figure 1:
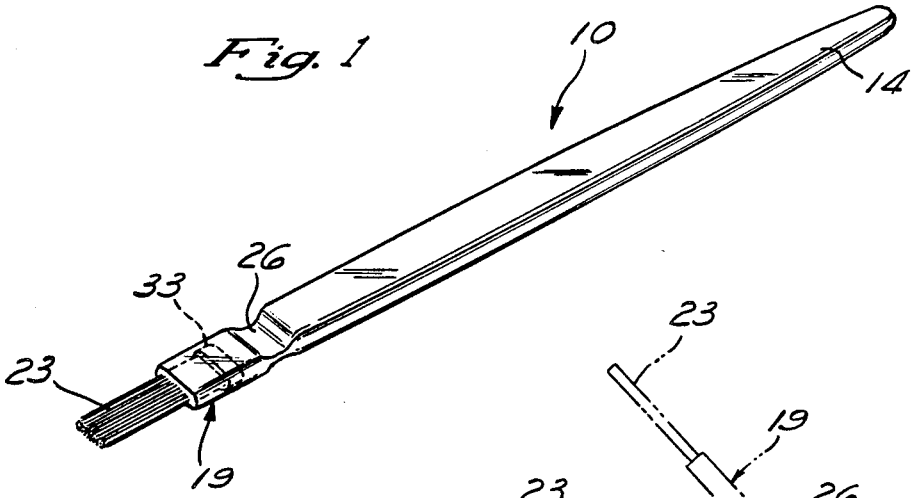
FIG. 1 is a perspective view showing a bendable brush pick according to the present invention when in the linear mode.

FIG. 1 shows a linear dental pick 10 having a wedge end 14 and a brush end 19 in accordance with the present invention. The wedge end 14 may be rounded as shown in FIG. 1, however it is also possible to make this end pointed in the manner of the more traditional toothpick appliances. The rounded wedge end 14 shown in FIG. 1 is more appropriate for use around the gingival margins of the teeth than is the conventional pointed end.

The brush end 19 of the dental pick 10 contains not only a brush 23, but also a neck 26 formed in the body of the linear dental pick 10 substantially adjacent to the inner terminus of the brush 23. The neck 26 enables the brush 23 to be manually bent or deflected at an angle from the remainder of the dental pick 10, (shown in phantom in FIG. 2), thereby increasing the utility of the appliance over a linear device. In the preferred embodiment, the dental pick 10 is constructed of a plastic material such as polypropylene or polyethylene, with the preferred material being polyethylene. As shown in FIG. 1, the dental pick 10 is somewhat flattened, with a lateral surface area that exceeds the thickness of the pick 10. Although not shown, it is also possible to make the pick 10 in a more rounded configuration without deviating from the principles of the present invention. In either case, by properly dimensioning the neck 26 in comparison to the thickness of the remaining body of the dental pick 10 it is possible to obtain an unusual and unexpected bending property of the plastic material.

Figure 2:
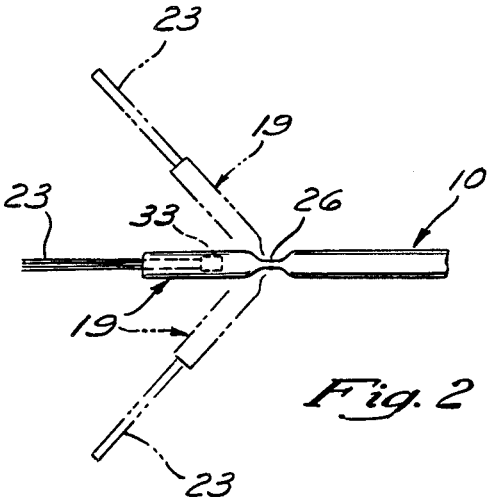
FIG. 2 is a partial side elevational view showing that portion of the pick having a brush, with two bent positions of the brush shown in phantom.

When the body of the dental pick 10 is shaped as shown in FIG. 1, with a general thickness adjacent the neck 26 of 0.08 inches (2 mm), tapering to a thickness of 0.04 inches (1 mm) at the wedge end 14, the linear body has a resilient, semi-rigid property, bending only with difficulty. The neck 26 has thickness of approximately 0.03 inches (0.8 mm) in comparison to the thickness of the dental pick body 10 on either side of the neck 26, 0.08 inches (2 mm) on one side and 0.088 inches (2.2 mm) at the brush end 19, (to accommodate the inserted portion of the brush 23). The reduction in thickness at the neck 26 provides substantially elastic rotational deformation from the plane containing the body of the dental pick 10. As dimensioned and when manufactured out of the previously mentioned plastics, by applying a bending force to the neck 26, the brush end 19 deflects from the initial linear position depicted in FIG. 1 to an angle in either direction of greater than 90°. FIG. 2 depicts (in phantom) two possible bends of approximately 45°. The angular range is of course infinitely variable between the greater than 90° limits. The brush end 19 will retain this angular deflection indefinitely, however when a different angular position is desired, application of an angular force to the brush end 19 will produce a change in the angular position of the brush end 19, and it is entirely possible to return to the linear position depicted in FIG. 1. This bending is almost entirely elastic in nature, with no work hardening or fracture failures noted, so long as sufficient time is provided for the internal heat generated by the bending to dissipate before additional bending of the plastic material occurs.

As discussed previously, the brush 23 is placed in and attached to the brush end 19 of the dental pick 10. A convenient method for retaining the brush 23 on the dental pick 10 is to insert a portion of the brush 23 into an opening formed in the brush end 19. Although not required for smaller-sized brushes and dental picks, the structural integrity of the brush, with respect to the individual brush threads, for the larger picks as shown in the drawings, is maintained by a brush clip 33. The clip 33 is also inserted into the brush end 19 in the preferred embodiment. After insertion, which may be by air pressure or other conventional means, the dental pick body 10 at the brush end 19 is slightly pressed together to retain the brush 23. The dental pick 10, itself, may conveniently be extruded in a well known manner, and, in the more flattened embodiment, the flat surfaces of the dental pick are suitable for having various identifying indicia formed therein during the extrusion process.

Figure 3:
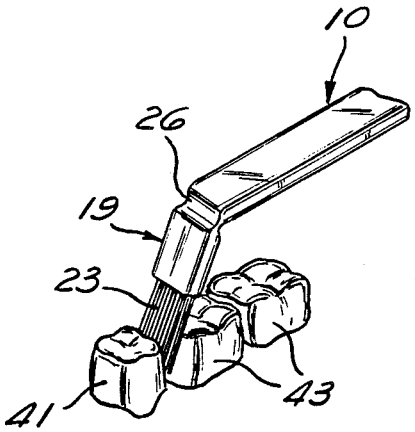
FIG. 3 is a partial perspective view of the pick with the brush portion bent, being used to clean teeth in accordance with the present invention.

FIG. 3 schematically shows the dental pick 10 in use providing dental hygienic action. The brush 23 is shown cleaning between a bicuspid 41 and a molar 43, the brush end 19 having been bent at the neck 26 to more easily place the brush 23 between the teeth. The toothpick 10 may also be used along both lateral sides of the dentition to clean the spaces between the teeth and also the gingival area of the teeth. In addition to supplying stimulation to the gum tissue, the dental pick 10 according to the present invention enables a modified brushing technique to be used after every snack or meal. From a cavity-prevention perspective, this appliance is a welcome addition to the normal routine of brushing only in the morning and at night before retiring, using the traditional toothbrush and toothpaste.

While I have disclosed an exemplary structure to illustrate the principles of the present invention, it should be understood that I wish to embody within the scope of the patent warranted hereon, all such modifications as reasonably and properly come within the scope of my contribution to the art.

What is claimed is:

1. A dental cleaning device comprising:

a thin, linear body of an extruded plastic material having a first and a second end disposed opposite one another;

a brush attached to and projecting linearly from said first end; and a neck formed in the extruded linear body substantially adjacent the area of attachment of said brush at the first end, said plastic material selected to permit the elastic deflection of said first end about the neck to a selective, fixed angular position, whereby the first end and the attached brush may be selectively bent about the neck to form an angle to the remainder of the linear body, permitting the brush to obtain enhanced access to tooth surfaces during the use of the cleaning device.

2. A dental cleaning device as described in claim 1, wherein said second end consists of a wedge end.

3. A dental cleaning device as described in claim 1, wherein said extruded linear body comprises a plastic material.

4. A dental cleaning device as described in claim 3, wherein said plastic material is a plastic selected from the group consisting of polyethylene and polypropylene.

5. A dental cleaning appliance as described in claim 4, wherein said plastic is polyethylene.

6. A dental cleaning device as described in claim 5, wherein said brush consists of nylon threads retained by a brush clip received within said first end of the linear body.

7. An improved dental cleaning appliance in the nature of a toothpick having a single extruded plastic material linear member with a dental treatment device fabricated at each end of said member, wherein the improvement comprises:

a brush end formed at one end of the single extruded linear member; and a neck formed in said linear extruded member adjacent to the brush end with the plastic material selected to permit the elastic bending of the single extruded member adjacent said brush end to a selective, fixed angular position, whereby the toothpick-type appliance is provided with a bendable, brush device to assist in the cleaning ability of the dental appliance.

8. An improved dental cleaning appliance as described in claim 7, wherein the single linear member is extruded polyethylene and said brush end comprises nylon bristles attached to said linear member.

9. A disposable dental cleaning appliance comprising:

a dental pick member having an extruded linear portion of a plastic material with a first end and a second end for the manual manipulation thereof during cleaning;

a first dental cleaning apparatus formed on the first end of said extruded dental pick member; and a second dental cleaning apparatus formed on the second end of said extruded dental pick member comprising:

a brush attached to the extruded dental pick member and projecting outwardly therefrom; and a neck formed in the extruded dental pick member adjacent said attached brush with said plastic material selected to permit the angular deflection of said brush from the pick member to a selective, fixed angular position, whereby the cleaning action of the disposable appliance is enhanced by the selective bending of the brush during the manual manipulation of the appliance.

* * * * *